US006561351B1

(12) United States Patent
Wright

(10) Patent No.: US 6,561,351 B1
(45) Date of Patent: May 13, 2003

(54) BAND BLADE DISPENSER

(76) Inventor: Stephen C. Wright, 4010 Jersey Ridge Rd., Davenport, IA (US) 52807

( * ) Notice: Subject to any disclaimer, the term of this patent is extended or adjusted under 35 U.S.C. 154(b) by 0 days.

(21) Appl. No.: 09/950,954

(22) Filed: Sep. 11, 2001

(51) Int. Cl.[7] ..... B65D 85/16

(52) U.S. Cl. ..... 206/349; 206/372; 206/409; 221/70

(58) Field of Search ..... 206/349, 352, 206/372, 395, 409; 229/103, 122; 221/70

(56) References Cited

U.S. PATENT DOCUMENTS 5,499,711 A * 3/1996 Kozak ..... 206/763

5,901,846 A * 5/1999 Betcher ..... 206/349

* cited by examiner

*Primary Examiner*—Jacob K. Ackun
(74) *Attorney, Agent, or Firm*—Sturm & Fix LLP

(57) ABSTRACT

A band blade package that allows removal of the band blade slowly, while at the same time releasing the potential energy of the coiled assembly in a controlled manner within the package and out of harms way. The band blade is placed in the package in a manner such that a loop of the band blade is adjacent to an opening in the packaging. The band blade can be removed by placing a loop of the band blade over a peg on a building wall and grasping both sides of the band blade package. As the package is pulled down, the coiled assembly of blades uncoils within the package and the blades are dispensed.

7 Claims, 5 Drawing Sheets

BAND BLADE DISPENSER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

1. Field of the Invention

This present invention relates to the field of band blade packaging, and more particularly to band blade packaging that aids in the dispensing of band blades.

2. Description of the Related Art

Blade packaging is well known in the art. Typical blade dispensers release band blade coil stock through a narrow slot. Typical band blade dispensers are not structured for dispensing a single or multiple quantity of endless blades.

As can be seen by reference to the following U.S. Pat. Nos. 3,667,592, and 3,944,072, the prior art is replete with band blade dispensers. U.S. Pat. No. 3,667,592, titled "Band Saw Carrier and Dispenser", is an invention designed to package and dispense band blades, but the invention is distinguished from the present invention by the lack of providing for dispensing of the continuous band blades. In addition, U.S. Pat. No. 3,944,072 titled "Octogonal Dispenser Carton for Band Saw Coils", is also an invention designed to package and dispense band blades, but it also lacks provision of dispensing of continuous band blades.

While all of the aforementioned prior art constructions are more than adequate for the basic purpose and function for which they have been specifically designed, namely the dispensing of continuous coil stock consisting of a head end and a tail end, they are uniformly deficient with respect to their failure to provide a safe, simple, efficient, and practical method for dispensing of endless band blades.

As a consequence of the foregoing situation, there has existed a longstanding need for a safe, new and improved endless band blade dispenser, and the provision of such a construction is a stated objective of the present invention.

BRIEF SUMMARY OF THE INVENTION

Briefly stated, the present invention provides a band blade dispenser capable of dispensing one or more band blades by exposing a loop of the band blades out of an opening from the dispenser and pulling down on the band blade dispenser package, as will be explained in greater detail further on in the specification. The present invention is comprised of a paperboard or like carton made up of a plurality of rectangular panels bent and assembled to form a right parallelepiped comprising a rear panel, a top panel affixed to the top of the rear panel, and a first and second side panels affixed to the side of the rear panel. The carton contains an additional lower compartment at the bottom of the main carton wherein the bottom of the band blade(s) is supported and secured. There is an opening in the edge wall joining the top and rear panels, through which a loop in the packaged band blade(s) may protrude. The first side panel contains an integral flap which closes over the aforesaid opening between the top and rear panels.

The band blade dispenser preferably allows removal of the band blade(s), while at the same time releasing the potential energy of the coiled assembly in a controlled manner within the package and out of harms way. The band blade is placed in the package in a manner such that a loop of the band blade(s) is adjacent to the opening in the packaging. The band blade can be removed by placing a loop of the band blade over a peg on a building wall(or other such protrusion) and grasping both sides of the band blade package. As the package is pulled down, the coiled assembly of blades uncoils within the package and the blades are dispensed.

BRIEF DESCRIPTION OF THE SEVERAL VIEWS OF THE DRAWING

These and other attributes of the invention will become more clear upon a thorough study of the following description of the best mode for carrying out the invention, particularly when reviewed in conjunction with the drawings, wherein.

DETAILED DESCRIPTION OF THE BEST MODE

Figure 1:
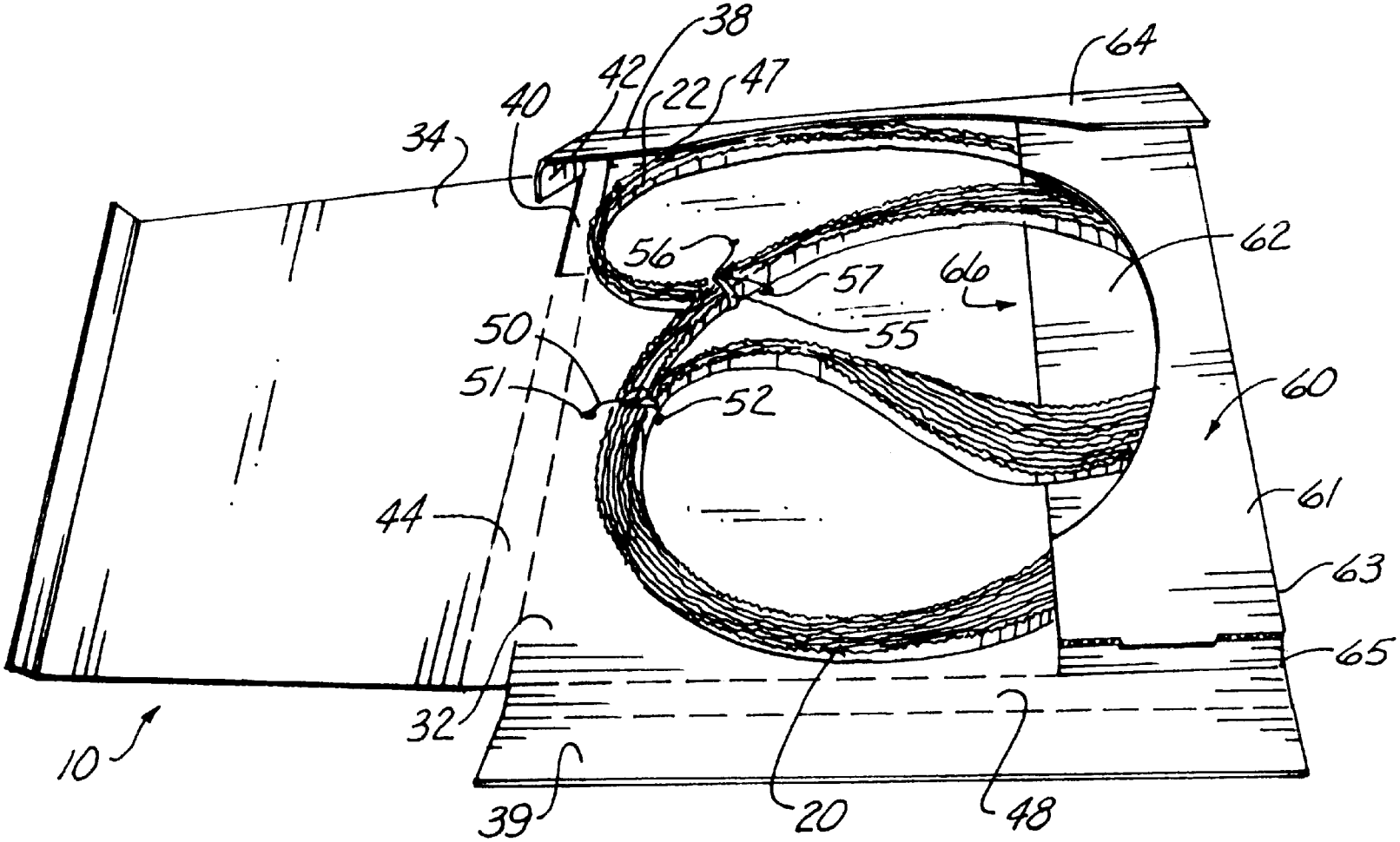
FIG. 1 is a perspective view of the blade dispenser embodying the concepts of the present invention opened with a band blade positioned inside and a side flap partially closed.

As can be seen by reference to the drawings, and particular to FIG. 1, the band blade dispenser that forms the basis of the present invention is designated generally by the reference number 10. A band blade 20 dispenser 10 embodying the present invention is composed of a paperboard or like carton made up of a plurality of rectangular panels bent and assembled to form a right parallelepiped.

The dispenser is composed of a rear panel 32, a top panel 34, a lower compartment 60, a first side panel 38, and a second side panel 39. The top panel 34 is affixed to the top of the rear panel 32, and the top panel 34 is adjacent to an opening 40 extending less than the entire width of the top panel 34, along the edge portion 44 adjacent to the rear panel 32. The lower compartment 60 is affixed to the bottom of the rear panel 32. The lower compartment 60 contains a front panel 61, a rear panel 62, a bottom panel 63 (FIG. 3), a first side panel 64, and a second side panel 65. There is no panel on the top 66 of the lower compartment 60, leaving the top 66 open. The band blade 20 is placed into the open top 66 of the lower compartment 60. The front panel 61 is partially cut away, exposing a portion of the band blade 20 resting inside the lower compartment 60. The first side panel 38 is affixed to the side of the rear panel 32, and the first side panel 38 contains an integral flap 42 along the exterior edge of the first side panel 38, adjacent to the opening 40 in the top panel 34. The first side panel 38 (FIG. 2) is partially cut away, exposing a portion of the band blade 20 resting underneath the first side panel 38. The second side panel 39 is affixed to the side of the rear panel 32.

The top panel 34 and the rear panel 32 are joined together by an edge wall portion 44 of the top panel 34, perpendicular to both the top panel 34 and the rear panel 32, with the edge wall 44 containing an opening 40 extending the entire width of the edge wall 44, but less than the entire length of the edge wall 44. The first side panel 38 and the rear panel 32 are joined by an edge wall portion 47 (FIG. 2) of the first side panel 38, perpendicular to both the first side panel 38 and the rear panel 32. The second side panel 39 and the rear panel 32 are joined by an edge wall portion 48 of the second side panel 39, perpendicular to both the second side panel 39 and the rear panel 32.

Figure 2:
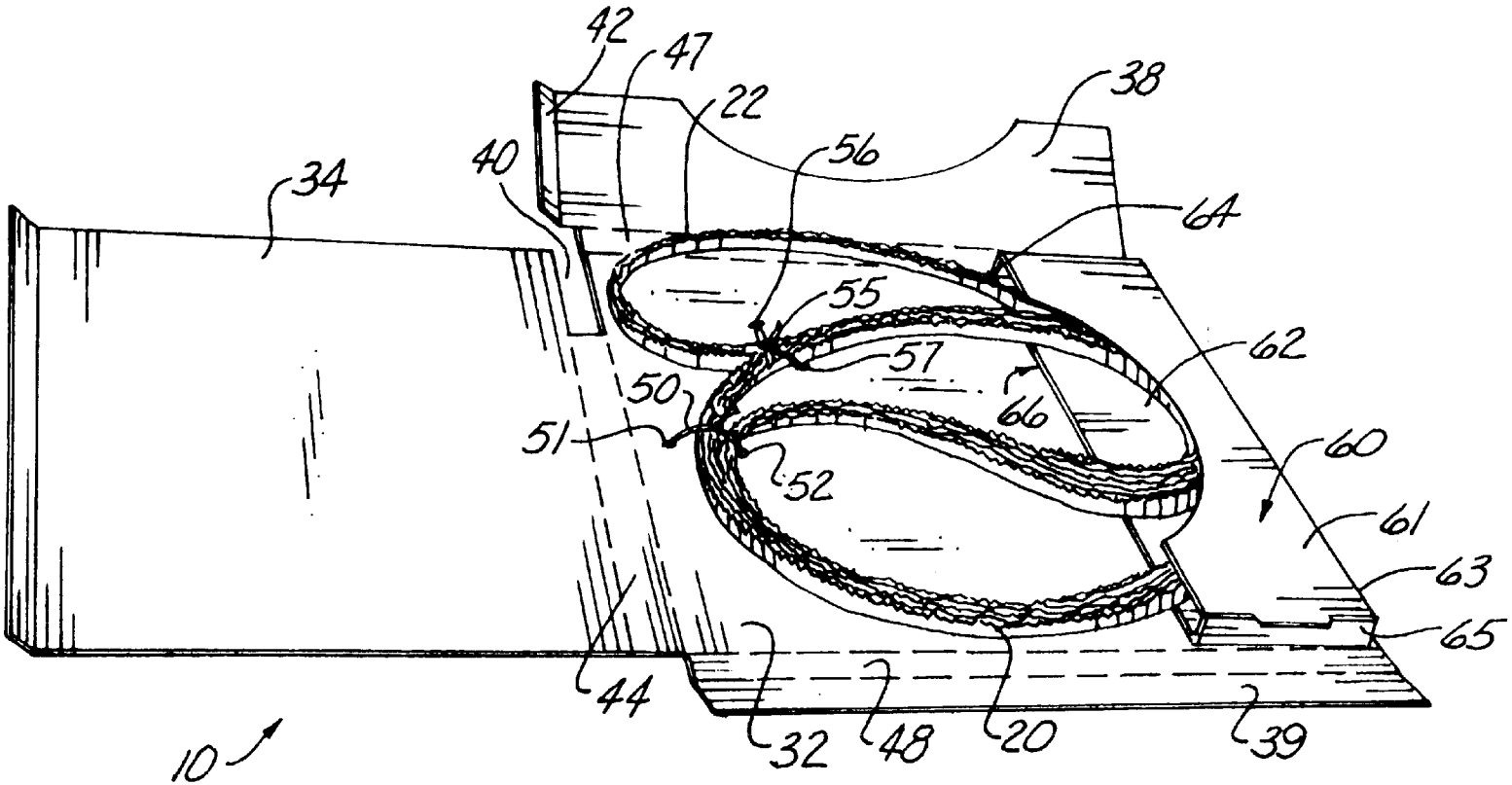
FIG. 2 is a perspective view of the blade dispenser embodying the concepts of the present invention opened with a band blade positioned inside, and the top flap shown on the left side.
Figure 3:
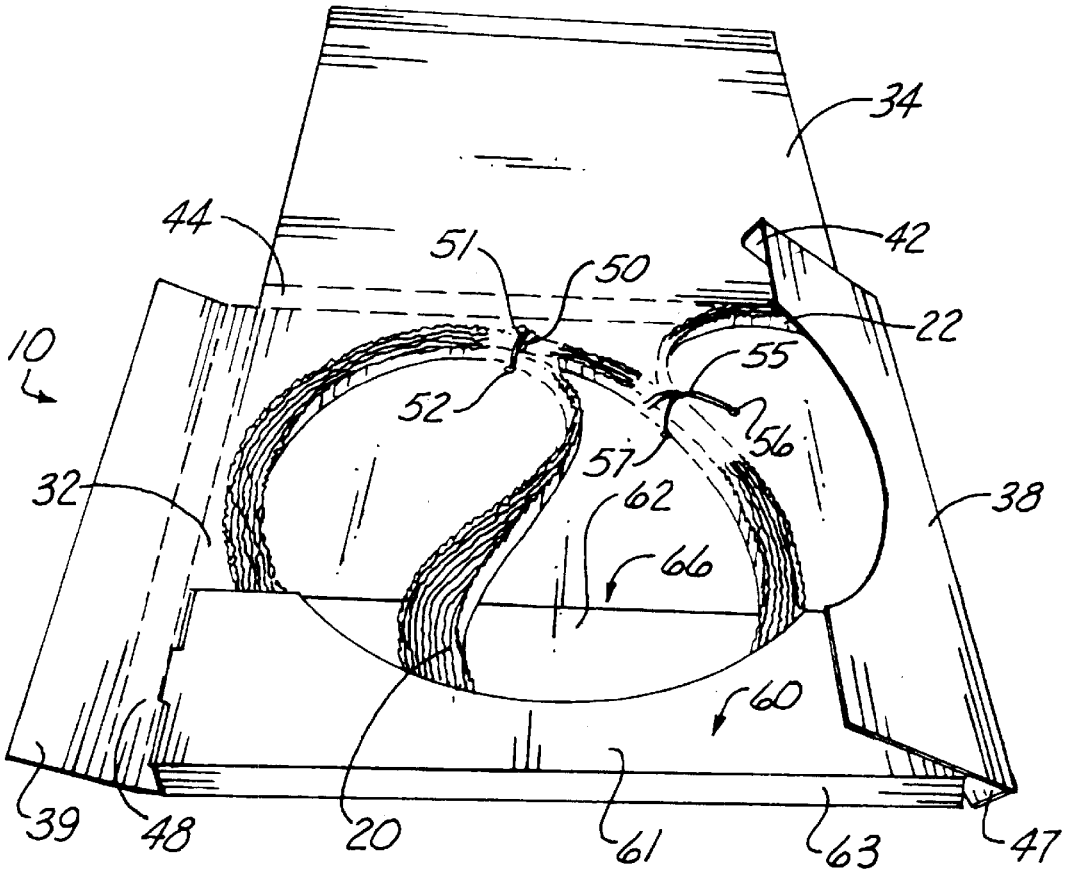
FIG. 3 is a perspective view of the blade dispenser embodying the concepts of the present invention opened with a band blade positioned inside, as seen with the top flap shown on top.
Figure 4:
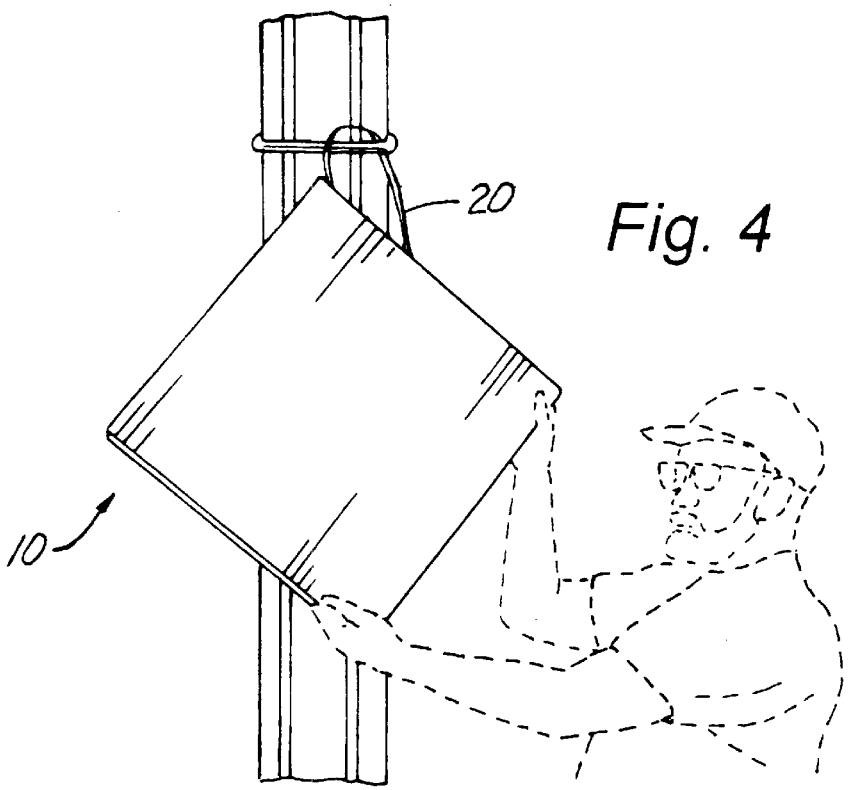
FIG. 4 is a perspective view of the dispenser packaging embodying the concepts of the present invention placed over a peg on a building wall.

As shown in FIG. 4, the band blade dispenser 10 closes completely for storage and transportation purposes of band blades 20. As shown in FIG. 2, the opening 40 in the edge wall 44 between the top panel 34 and the rear panel 32 is large enough to allow a loop 22 of the band blade 20 to be pulled through. The aforesaid opening 40 in the band blade dispenser 10 contains an openable flap 42. When this flap 42 is opened, a loop 22 in the band blade 20 is visible from outside the band blade dispenser 10. The rear panel 32 of the band blade dispenser 10 preferably contains two holes 52,53 through which a first tie wrap 50 may be put through, and two additional holes 56,57 through which a second tie wrap 55 may be put through.

In use, as shown in FIG. 1, the band blade dispenser 10 opens up to allow the insertion of a band blade 20 into the dispenser 10. The top panel 34, first side panel 38, and second side panel 39 open outwardly to allow a band blade 20 to be placed therein. The bottom of the band blade 20 is placed into the lower compartment 60. Preferably, two ties 50,55 are attached around the band blade 20 to hold the coiled band blade 20 together. The first tie 50 is looped through the holes 52,53 in the rear panel 32 of the dispenser 10, and the second tie 55 is looped through the holes 56,57 in the rear panel 32. A loop 22 of the band blade 20 is positioned adjacent to the aforesaid opening 40 between the top panel 34 and the rear panel 32. The band blade dispenser 10 is closed by folding the top panel 34, the first side panel 38, and the second side panel 39 inwardly over and against the bland blade 20 inside the dispenser 10.

Figure 5:
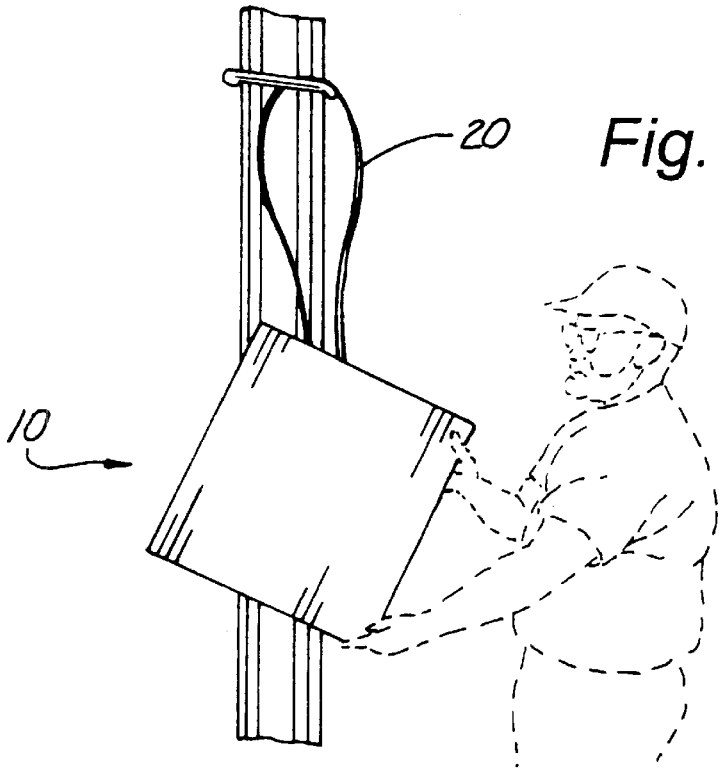
FIG. 5 is a perspective view of the dispenser packaging embodying the concepts of the present invention with a blade partially pulled out of the dispenser.

When the owner of the band blade 20 is ready to use the band blade 20, the flap 42 covering the loop 22 in the band blade 20 is opened. As shown in FIG. 4, a preferred process of dispensing a band blade 20 begins with pulling the band blade loop 22 out of the opening 40 in the dispenser 10. Once the loop 22 protrudes sufficiently out of the dispenser 10, the loop 22 is placed over a peg on a building wall. As shown in FIG. 5, the next step in dispensing a band blade 20 entails grasping the dispenser 10 and slowly pulling down on the dispenser 10 packaging while the band blade 20 is slowly removed from the dispenser 10. As the coiled band blade 20 is removed slowly from the dispenser package 10, the potential energy of the coiled assembly of the band blade 20 is released in a controlled manner within the dispenser package 10.

Figure 6:
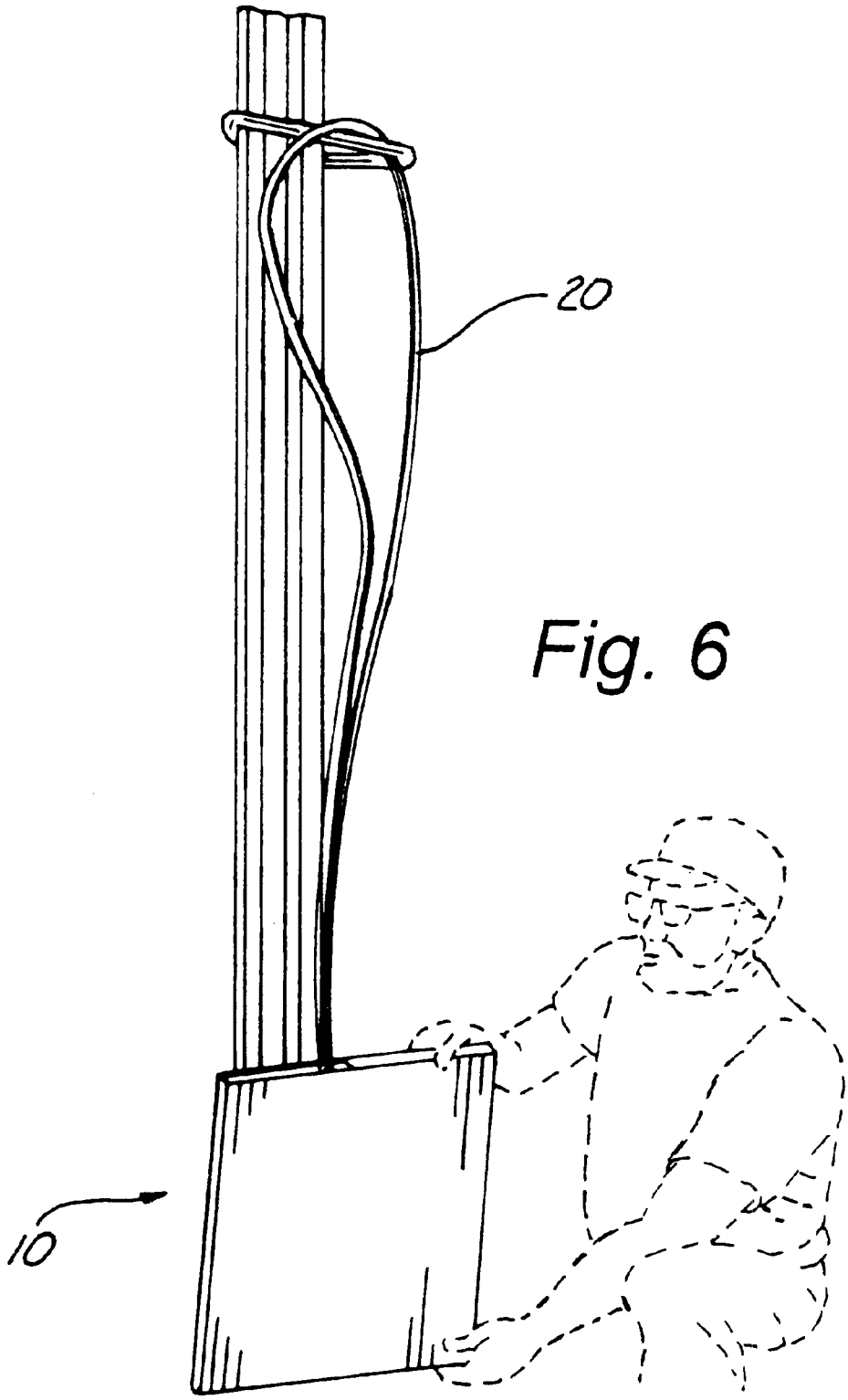
FIG. 6 is a perspective view of the dispenser packaging embodying the concepts of the present invention with a blade pulled further out of the dispenser than in FIG. 5.

As seen in FIG. 6, the band blade dispenser 10 is pulled completely downward until the band blade 20 is completely removed from the dispenser packaging 10. The person removing the band blade 20 preferably does not require gloves to remove the band blade 20 in the aforementioned manner.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A paperboard or like carton made up of a plurality of rectangular panels bent and assembled to form a right parallelepiped comprising:

a rear panel;

a top panel affixed to the top of said rear panel, wherein said top panel is adjacent to an opening extending less than the entire width of said top panel, along the edge portion adjacent to said rear panel;

a lower compartment affixed to the rear panel, said lower compartment comprising a front panel partially cut away to show band blades within said lower compartment, a rear panel, a bottom panel, a first side panel, and a second side panel;

a first side panel affixed to the side of said rear panel, said first side panel containing an integral flap along the exterior edge of said first side panel, adjacent to said opening in said top panel; and a second side panel affixed to the side of said rear panel.

2. The carton of claim 1, wherein said top panel and said rear panel are joined together by an edge wall portion of said top panel, perpendicular to both of said walls, said edge wall containing an opening extending the entire width of said edge wall, but less than the entire length of said edge wall.

3. The carton of claim 1, wherein said first side panel and said rear panel are joined by an edge wall portion of said first side panel, perpendicular to both of said walls.

4. The carton of claim 1, wherein said second side panel and said rear panel are joined by an edge wall portion of said second side panel, perpendicular to both of said walls.

5. The carton of claim 1, wherein said first side panel is partially cut away to show band blades beneath said first side panel.

6. A method of loading a band blade into a paperboard or like carton made up of a plurality of rectangular panels bent and assembled to form a right parallelepiped comprising:

a rear panel;

a top panel affixed to the top of said rear panel, wherein said top panel contains an opening extending less than the entire width of said top panel, along the edge portion adjacent to said rear panel;

a lower compartment affixed to the rear panel, said lower compartment comprising a front panel partially cut away to show band blades within said lower compartment, a rear panel, a bottom panel, a first side panel, and a second side panel;

a first side panel affixed to the side of said rear panel, said first side panel containing an integral flap along the exterior edge of said first side panel, adjacent to said opening in said top panel; and a second side panel affixed to the side of said rear panel, comprising the steps of:

a. opening said carton by unfastening the top panel, the first side panel, and the second side panel;

b. positioning a band blade flat against said rear panel in said dispensing carton, and securely in said lower compartment;

c. attaching ties to hold together said band blade;

d. positioning a loop of said band blade adjacent to said opening in said dispensing carton; and e. closing said dispensing carton by refastening the top panel, first side panel, and second side panel.

7. A method of unloading a band blade from the carton of claim 6 comprising:

a. opening said flap affixed to said first side panel in said dispensing carton;

b. cutting said ties affixing said endless band blade to said dispensing carton;

c. exposing said loop in said band blade through said hole in said dispensing carton;

d. engaging said loop in said band blade with a peg or protrusion extending from a wall; and e. pulling said dispensing carton downward until said band blade uncoils and is removed from said dispensing carton.

* * * * *